United States Patent [19]

Matsubara

[11] Patent Number: 4,822,966

[45] Date of Patent: Apr. 18, 1989

[54] METHOD OF PRODUCING HEAT WITH MICROWAVES

[76] Inventor: Yuzuru Matsubara, Kitayama 220, Kitayama-cho, Owariasahi-shi, Aichi-ken 488, Japan

[21] Appl. No.: 245,968

[22] Filed: Sep. 16, 1988

[30] Foreign Application Priority Data

Jan. 27, 1986 [JP] Japan ..... 61-43091

Related U.S. Application Data

[63] Continuation of Ser. No. 18,102, Feb. 20, 1987, abandoned.

[51] Int. Cl.[4] ..... H05B 6/80

[52] U.S. Cl. ..... 219/10.55 M; 219/10.55 F; 219/10.55 A; 264/26; 426/243

[58] Field of Search ..... 219/10.55 M, 10.55 E, 219/10.55 F, 10.55 R, 10.55 A; 34/1; 264/25, 26; 99/DIG. 14; 426/243, 241, 234

[56] References Cited

U.S. PATENT DOCUMENTS

| | | | |
|---|---|---|---|
| 3,469,053 | 9/1969 | Levinson | 219/10.55 E |
| 3,731,037 | 5/1973 | Levinson | 219/10.55 E |
| 3,783,220 | 1/1974 | Tanizaki | 219/10.55 E |
| 3,941,967 | 3/1976 | Sumi et al. | 219/10.55 E |
| 3,974,354 | 8/1976 | Long | 219/10.55 E |
| 4,057,702 | 11/1977 | Lacombe-Allard | 219/10.55 M X |
| 4,267,420 | 5/1981 | Brastad | 219/10.55 E |
| 4,307,277 | 12/1981 | Maeda et al. | 219/10.55 R |
| 4,362,917 | 12/1982 | Freedman et al. | 219/10.55 M |
| 4,369,346 | 1/1983 | Hart et al. | 219/10.55 E |
| 4,495,392 | 1/1985 | Derby | 219/10.55 E |
| 4,663,506 | 5/1987 | Bowen et al. | 219/10.55 F X |

*Primary Examiner*—Philip H. Leung

*Attorney, Agent, or Firm*—Flynn, Thiel, Boutell & Tanis

[57] ABSTRACT

A microwave energy source is associated with a heating medium containing a microwave energy absorption material so that the heating medium is heated to a high temperature when it is irradiated with microwave energy and produces infrared heat energy. The heating medium can be incorporated in a cooking dish or on the interior of a heat insulating housing.

4 Claims, 7 Drawing Sheets

METHOD OF PRODUCING HEAT WITH MICROWAVES

This application is a continuation of U.S. Ser. No. 018,102, filed Feb. 20, 1987, now abandoned.

BACKGROUND OF THE INVENTION

1. Field of the Invention

The present invention relates to a method of producing heat with use of microwaves capable of directly producing the heat from an article to be heated by irradiating the article with microwaves thereonto.

2. Description of the Prior Art

Conventionally, a heating apparatus for applying china-painting on an article such as pottery and glass containers, etc., bakes the article at high temperature in a baking furnace in a factory of manufacturing it, and hence it requires an exclusive calcining furnace capable of being raised to a high temperature. Accordingly, it was impossible to find pleasure personally in baking the article for china painting.

In addition, in a heating apparatus for cooking, microwaves for irradiation are absorbed by a material to be cooked, which material is thus cooked by heat produced in itself. Thereupon, pottery and a glass container to house the material do not absorb the microwaves, so that the material is insufficiently heated, unlike direct heating, and it cannot be nice-smelling with the browned parts thereof. Moreover, the material to be cooked produces heat substantially due to collision of constituent molecules thereof with surrounding water molecules, and hence a material with a reduced content of water therein has bad efficiency to produce heat. Furthermore, the material cannot raise its temperature beyond the boiling point of the water contained therein and thereby cannot be cooked under strong heating.

Furthermore, in a microwave heating apparatus, an article to be heated disposed in the interior of a furnace body and heat insulated from the outside is directly irradiated with microwaves supplied exteriorly of the furnace for its heating. However, a heating apparatus of this type is adapted to directly heat an article to be heated. Accordingly, provided the article absorbs few microwaves, the conversion efficiency of irradiated microwaves becomes low. Thus, it was impossible to heat the article to desired high temperature. For example, to heat an article with little absorption of microwaves, such as pottery and the like, to high temperature for drying and calcining them, the apparatus could not work out effectively.

Furthermore, another microwave heating apparatus, e.g., a continuous type, is adapted in general to have its burning part for gas or liquid fuel disposed along the way in which the workpieces are fed. However, the pressure in its furnace is varied due to combustion gas produced upon combustion, so that adjustment of the temperature and the atmosphere in the furnace is difficult, as well as uniform heating over an article to be heated is impossible, and bad thermal efficiency is achieved owing to discharge of high temperature combustion exhaust gas.

To solve the drawbacks of the prior arts described above, it is an object of the present invention to provide a method of baking an article such as pottery and glass containers, etc., at high temperature for applying china painting thereonto with use of a domestic electronic oven.

Another object of the present invention is to provide a method of assuring ideal cooking by properly balancing, upon heating a material to be cooked and adjusting the degree of the heating in the domestic electronic oven, the radiation heat available from the glass vessel itself produced as a result of irradiation of microwaves thereonto and the heating of the material by microwaves directly acting thereon.

Still another object of the present invention is to provide a method of producing heat by microwaves with use of a simple structured furnace having a heat producing wall of higher microwave absorption efficiency, said wall enabling effective microwave heating.

To achieve the above objects, a method of producing heat with microwaves according to the present invention comprises:

(1) a method of producing heat adapted to mix or adhere a microwave absorption material and/or metal particles into or to a heating medium, and irradiate the heating medium with microwaves;

(2) a method of producing heat for cooking adapted to mix or adhere a microwave absorption material and/or metal particles into or to a heating medium mainly composed of a pottery raw material and irradiate the heating medium with microwaves;

(3) a method of producing heat for china-painting adapted to form a container to be housed in a domestic electronic oven with a heat insulating material, house an article to be subjected to china-painting, such as pottery and glass container, etc., in the container, arrange a heating medium with use of a microwave absorption material and/or metal particles as a main component on an inner peripheral wall part of the housing part in a confronting relation with a surface of the article subjected to china-painting, and irradiate the heating medium so provided with microwaves;

(4) a method of producing heat for cooking adapted to dispose a heating medium mainly composed of a microwave absorption material on an inner wall part of an outer casing comprising a heat insulating material, mount a container in a surrounding relation by the treating medium, put a cover on the container, and irradiate the heating medium with microwaves;

(5) a method of producing heat adapted to form a heating wall material with use of a material mainly composed of a microwave absorption material and metal particles via a heat resisting binder, construct a furnace wall of a furnace with use of the heating wall material while arranging a heat insulating material capable of transmitting microwaves on an outer periphery of a heating conductor, dispose a microwave irradiation equipment externally of the heat insulating material in a confronting relation with the heating wall material, and irradiate the heating wall material with microwaves from the microwave irradiation equipment;

(6) a method of producing heat adapted to arrange a tunnel-shaped furnace in the course of a conveyance path for a conveyor device serving to place on article to be heated thereon and convey the article, dispose a heating medium comprising a material mainly composed of a microwave absorption material on the inner wall surface of the tunnel-shaped furnace, arrange a microwave irradiation equipment for microwave irradiation externally of the furnace in a confronting relation with the heating medium, and irradiate the heating wall material with microwaves radiated from the microwave irradiation equipment.

According to the present invention, as described above, a heating medium effectively absorbs irradiated microwaves, whereby the heating medium reaches high temperature in a short time, while an article to be heated is heated by radiation heat in the same manner as being subjected to an open fire, and dried and baked. In addition, in baking a pattern applied on a surface of an article such as pottery and glass containers, the pattern is first drawn on the surface of the article with use of paints of a metallic oxide capable of producing a prescribed color when calcined, and the article is housed in the housing part and sealed. Then, with the heating medium irradiated with microwaves, the heating medium reaches high temperature in a short time, becomes red-hot, and radiates radiation heat. Hereby, the article is indirectly heated and hence the pattern is oxidized and baked on a base surface of the article. Moreover, upon cooking, various articles to be cooked are put in the heating apparatus, and with a heating medium irradiated with microwaves the heating medium reaches high temperature in a short time and becomes red-hot. Thus, the article is cooked by radiation heat from the heating medium under the same heating conditions as those in heating cooking by an open fire. Furthermore, in irradiating a heating wall material with microwaves from the microwave irradiation equipment after an article to be heated is housed in the furnace in opposition to the heating wall material, the heating wall material is irradiated with the microwaves through an insulating material, and hence the heating material absorbs the microwaves and produces heat, while carbon components contained in the metal particles likewise produce heat. Still more, the furnace is adapted to properly reflect microwaves existent therein to permit absorption efficiency thereof by microwave absorbing components to be increased and thereby the heating wall material to be heated in itself to high temperature. In addition, owing to the action of radiation heat by the microwaves so reflected in the furnace an article disposed in the furnace is indirectly heated. Furthermore, by employing the present heating apparatus as a conveyance and an equipment of continuously producing heat, a temperature gradient through the furnace body can arbitrarily set by adjusting the intensity of microwaves irradiated from the microwave irradiation equipment, whereby pottery, foods, and other articles to be heated can be dried or baked properly.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

An embodiment of a heating apparatus according to the present invention will be described with reference to the accompanying drawings.

Figure 1:
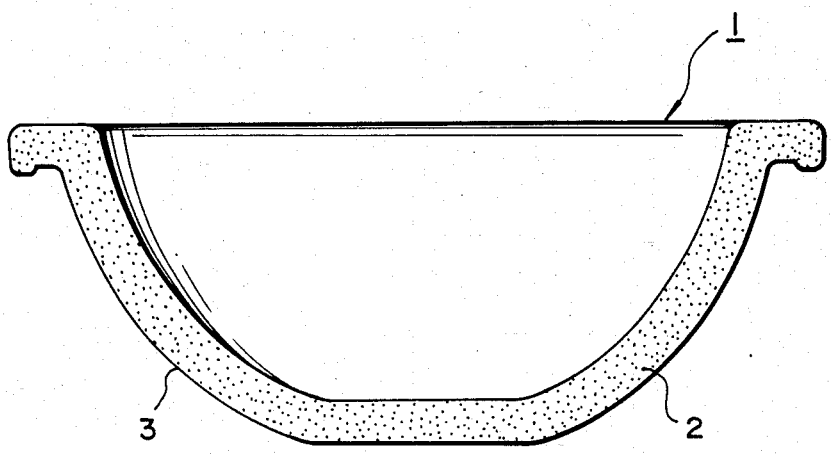
FIG. 1 is a cross sectional view illustrating a cooking heating apparatus according to the present invention.

As shown in FIG. 1, designated at 1 is a cooking and heating apparatus, such as a dish, a pot, a ceramic plate etc., mainly composed of a pottery raw material, and a heating medium 2 of the heating apparatus 1 containing a microwave absorption material 3 comprising powdered carbon and silicon carbide mixed thereinto. The apparatus is formed into an arbitrary shape through ordinary processes of forming, painting, drying, and calcination.

In addition, the rate of mixing the microwave absorption material 3 into the heating medium 2 is desirably set to 50% or more when expecting effective heating, but it may also be 50% or less without any limit thereto.

Figure 2:
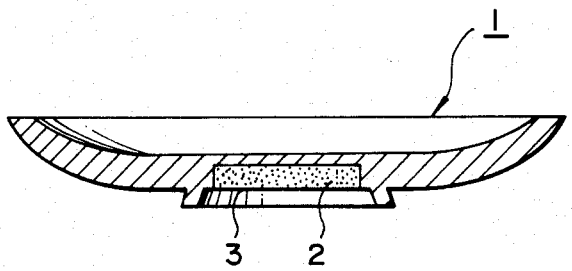
FIGS. 2 and 3 are respectively a cross sectional view illustrating another embodiment.
Figure 3:
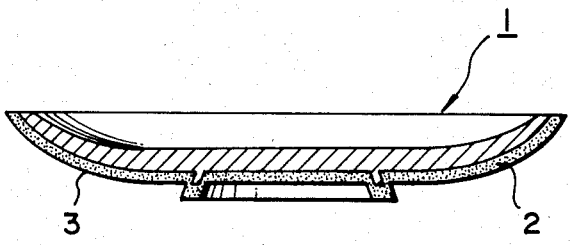

Moreover, the microwave absorption material 3 may be adapted to adhere to part of an outer surface of the heating medium 2 or the whole surface thereof as shown in FIGS. 2 and 3 by applying the microwave absorption material 3 mixed into a proper adhesive material on the outer surface of the heating medium 2 at a proper location and baking it at high temperature or sintering it into a thin sheet via a heat resistant binder.

Hereupon, to further improve the efficiency of heat production of the heating medium 2, proper metallic powder such as casting powder, brass powder, and aluminum powder, etc., may be mixed into the heating medium 2 in addition to the microwave absorption material 3, and more particularly casting powder containing carbon may be optimum as material quality although the mixing rate of metallic powder and material quality is not limited in particular.

Figure 4:
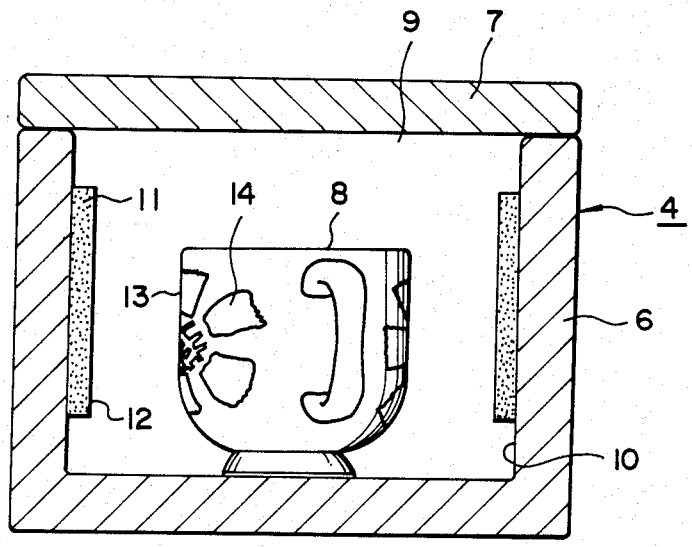
FIGS. 4 and 5 are respectively a cross sectional view illustrating subjecting pottery to china painting, etc., with use of a microwave absorption material according to the third embodiment.
Figure 5:
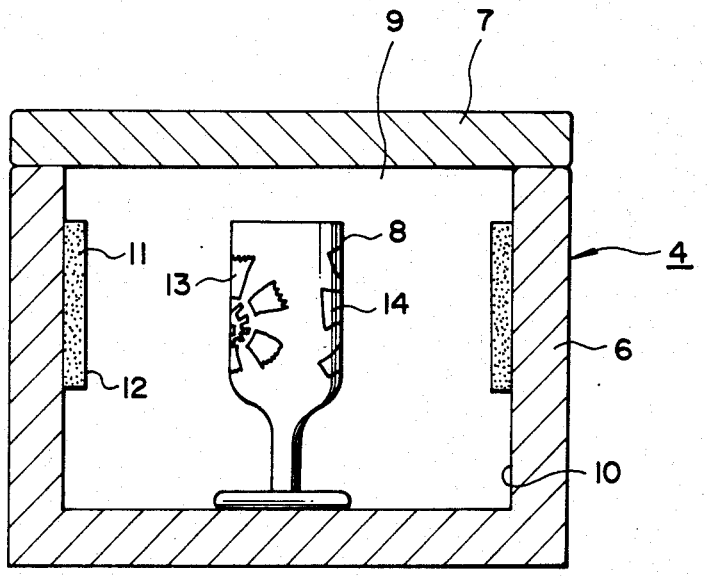
Figure 6:
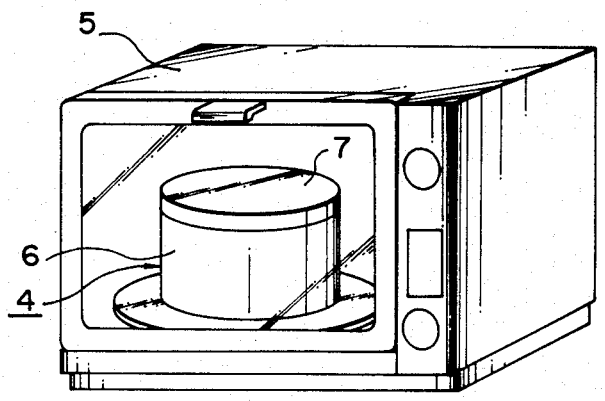
FIG. 6 is a perspective view illustrating the same.

Moreover, describing the third embodiment, as shown in FIG. 4, designated at 4 is a painting heating apparatus for pottery, etc., which is box-shaped and sized so as to be housed in a cooking part of an electronic oven 5 and is composed of a closed top container comprising a container 6 and a cover 7 formed with a proper heat insulating material of reduced microwave loss, the interior of which container 6 is employed as a housing part 9 of an article 8 such as a dish and a cup, etc., made of pottery and glass. In addition, the heating apparatus 4 is adapted to have arranged on the inner peripheral wall part 10 of the housing part 9, at a proper position thereon, a heating medium 12 mainly composed of a microwave absorption material 11 comprising powder of carbon and silicon carbide, etc., serving to absorb microwaves and thereby produce heat, in a confronting relation with the painting surface 13 of the article 8.

Moreover, the heating medium 12 is formed by applying the microwave absorption material 11 mixed into a proper adhesive material on the inner peripheral wall part 10 at a proper position thereof and baking it at high temperature or sintering it into a thin plate via a heat resistant binder.

Designated at 14 is a pattern arbitrarily drawn on a surface of the article 8 with use of a metal oxide developing a proper color due to high temperature oxidation by means of a writing brush and any transfer, etc.

Hereupon, to further improve efficiency of producing heat from the heating medium 12 of the painting heating apparatus 4, proper metallic particles such as casting powder, brass powder, and aluminum powder, etc., may be mixed into the heating medium 12 as a main component thereof in addition to the microwave absorption material.

Figure 7:
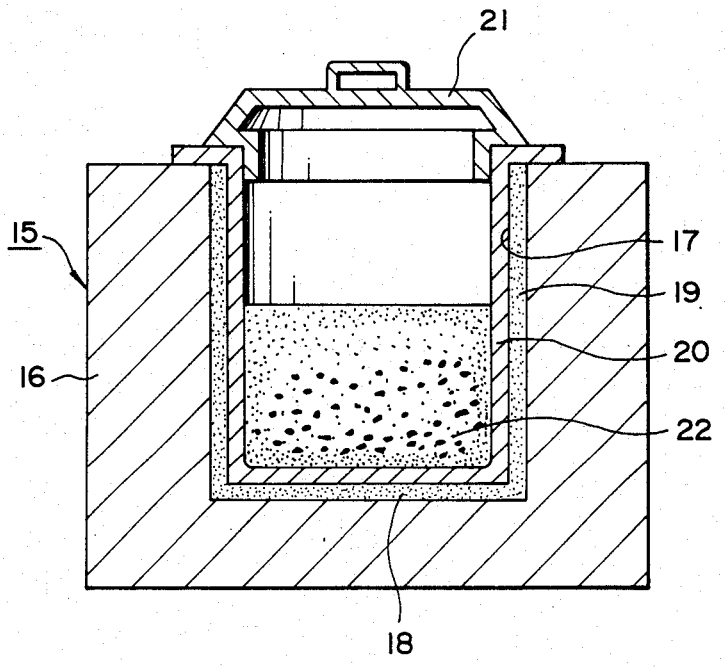
FIG. 7 is a cross sectional view illustrating a state of use of a cooking heating apparatus according to the fourth embodiment.
Figure 8:
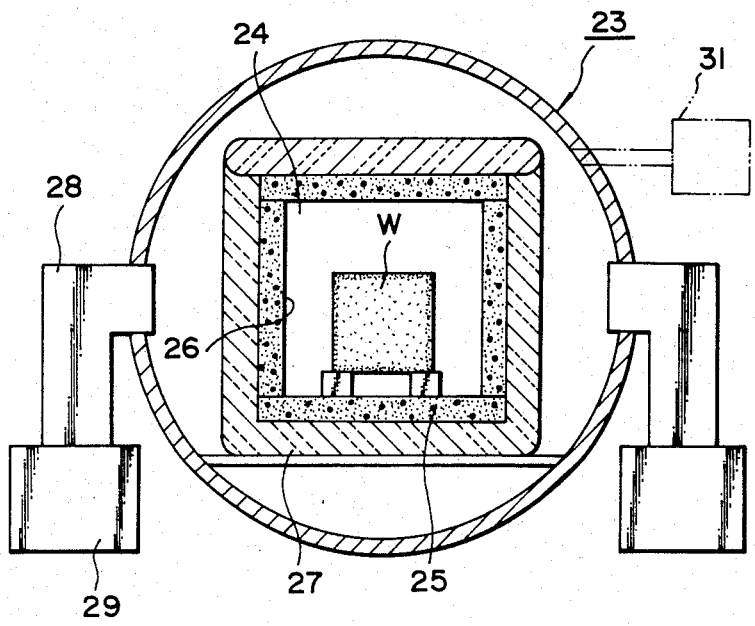
FIG. 8 is a cross sectional view illustrating a state of use of a heating apparatus according to the fifth embodiment.
Figure 9:
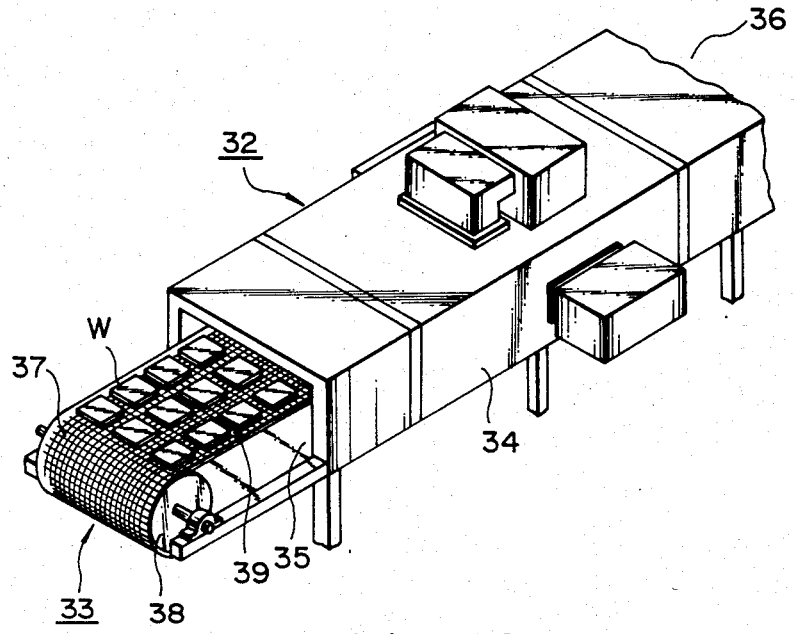
FIG. 9 is a perspective view illustrating a state of use of an apparatus of continuously producing heat according to the sixth embodiment.
Figure 10:
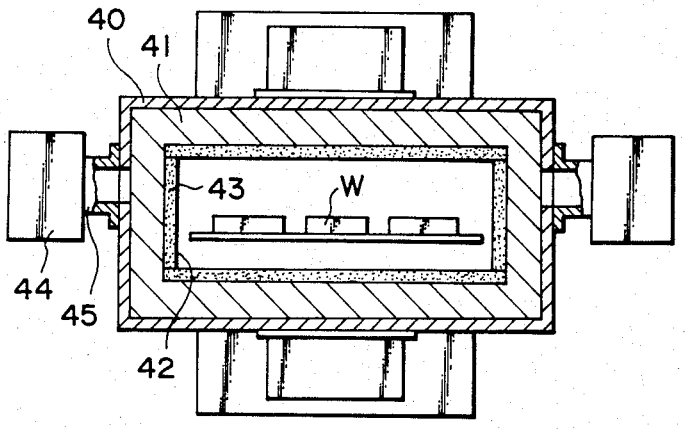
FIG. 10 is a cross sectional view illustrating a state of use of the sixth embodiment.

In succession, describing the fourth embodiment, as shown in FIG. 7, designated at 15 is a cooking heating apparatus for cooking rice, meat, and foods, etc., housed in the electronic oven, which is adapted to have on the peripheral and bottom surfaces a heating medium 19 mainly composed of a microwave absorption material 18 comprising carbon and silicon carbide, etc., or formed by mixing proper metal particles such as casting powder, brass powder, and aluminum powder, etc., and applied on an inner wall part 17 of an outer thick cylindrical casing 16 constructed properly with a heat insulating material via a heat insulating binder and sintered into a thin plate or applied by properly mixing the microwave absorption material 18 into an adhesive material, and furthermore baked at high temperature into a lamellar shape.

Moreover, the heating medium 19 is adapted to have a cooking container 20 such as a pan, an iron pot, and a frying pan, etc., on an inner peripheral surface part thereof so as to surround it in contact with an outer periphery of the container 20, the container 20 being furthermore covered removably with a cover 21 on the upper end opening part thereof.

Moreover, the container 20 and the cover 21 respectively employ a material capable of transmitting microwaves such as pottery, etc., or a metallic material capable of reflecting microwaves such as aluminum and stainless steel, etc., selectively in response to the purpose in concern. Thereupon, the microwave transmitting material allows an article 22 to be cooked placed in the container 20 to be directly heated by transmission of microwaves through the container 20 or the cover 21, while the microwave reflecting material allows the article 22 to be cooked only with a heating action by radiation heat from the container 20 while shielding irradiation of microwaves into the article 22.

Describing then the fifth embodiment, designated at 23 is a heating apparatus, which consists of a lamellar heating medium 25 to construct prescribed in-furnace space 24, the heating medium 25 including a microwave absorption material mainly composed of carbon and silicon carbide capable of sufficiently absorbing microwaves, and proper metal particles such as casting powder, brass powder, and alumina powder, etc., into a proper shape corresponding to the heating medium 25 via a proper heat resistant binder to thereby form the heating wall material 26 which per se comprises the heating medium 25 of the heating equipment 23.

Moreover, although the rate of the mixing of the metal particles and the material quality thereof are not limited in particular, casting powder, etc., containing a carbon fraction may be optimum as the material quality.

Furthermore, a fibrous heat insulating material 27 is arranged on an outer peripheral part of the heating wall material 26, which comprises a material of low microwave loss for blocking heat radiation directed outwardly of the heating wall material 26, while a microwave irradiation equipment 29 is arranged outwardly of the heating wall material 26 via a waveguide 28 for guiding microwaves from the outside of the heating apparatus 23 in a confronting relation with an arbitrary wall surface of the heating wall material 26.

Moreover, the heating apparatus 23 is adapted to be covered with an outer casing member 30 in an air-tight manner at need while it may be adapted to have the furnace interior space 24 thereof made vacuum by connecting a vacuum pump 31 with an inside space of the outer casing member 30.

In succession, describing the sixth embodiment, designated at 32 is a continuous microwave heating apparatus, which consists of a conveyor device 33 for successively placing articles W to be heated thereon in order and conveying them, and tunnel-shaped furnace 34 arranged in the course of a conveyance path.

The conveyor device 33 comprises a net conveyor 37 disposed from an inlet 35 to an outlet 36 of the furnace 34, wherein articles W to be heated are placed and aligned on a heat resistant net 39 driven by a roller 38 and further conveyed in the furnace 34 and allowed to pass therethrough.

The furnace 34 consists of a heat insulating material 40 comprising a material of reduced microwave loss and an outer casing 41 adapted to cover the heat insulating material 40 therewith and be capable of reflecting microwaves incident thereon. On a furnace wall 42 inside the furnace 34, a heating medium 43 is arranged at a prescribed position thereof set corresponding to the temperature gradient specified for drying and calcining an article W to be heated such as pottery, foods, and other proper materials, and disposed in a confronting relation with the upper and lower surfaces and left and right surfaces of the conveyor device 33 or an arbitrary surface thereof. The heating medium 43 comprising a microwave absorption material mainly composed of carbon and silicon carbide capable of highly absorbing microwaves or a material obtained by properly mixing metal particles such as casting powder, brass powder, and alumina powder, etc., into the microwave absorption material.

Moreover, the furnace 34 is adapted to have a microwave irradiation equipment 44 disposed outwardly thereof, while it is adapted to have a waveguide for guiding microwaves radiated from the microwave irradiation equipment 44 introduced into and connected with the furnace wall 42 in opposition to a position of arranging the heating medium 43.

Figure 11:
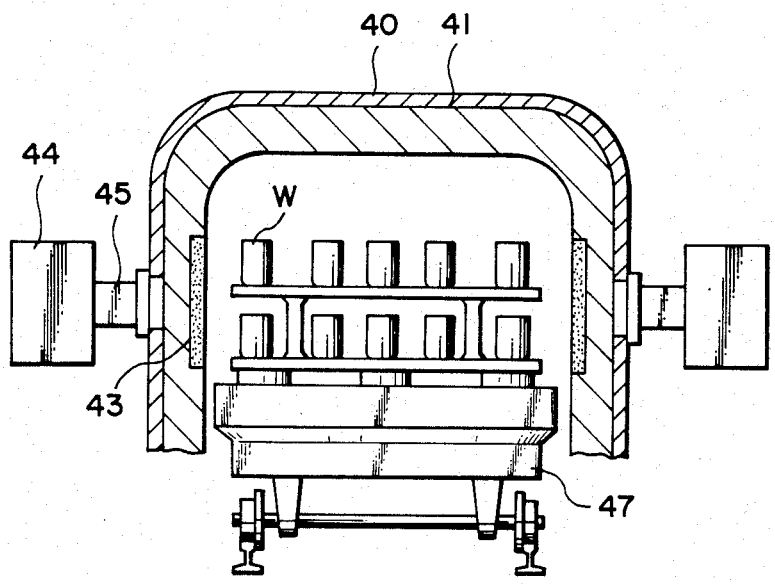
FIG. 11 is a cross sectional view illustrating another embodiment according to the sixth embodiment.

Still more, FIG. 11 shows another embodiment arranged with a truck 47 pushed and conveyed continuously.

Describing in succession a method of producing heat according to the present invention, in the cooking heating apparatus, various kinds of articles to be cooked are first put into the heating medium 2, the heating medium 2 being disposed in a cooking part of the electronic oven. Turned on the electronic oven in accordance with an ordinary method of cooking, microwaves being irradiated are effectively absorbed by the microwave absorption material 3 upon passing through the heating medium 2 to the electronic oven to permit the heating medium 2 to reach high temperature in a short time. Due to the heat transfer property of the heating medium 2, the article placed interiorly of the heating medium 2 is directly heated from the inner wall part of the heating medium under the same conditions as those in cooking by an open fire.

Moreover, the article to be cooked undergoes not only the heat transfer action from the wall surface of the heating medium 2 but heating action caused by ordinary microwave absorption by the article for achieving effective cooking by heating.

Still more, it has been found experimentally that when the microwave absorption material 3 and the metal particles are mixed in a ratio of about 10:4, heat production of the heating medium 2 by microwaves is improved wherein the temperature is raised and that speed of the temperature is increased by about 50% as compared with a case of the use of only the microwave absorption material 3.

According to the third embodiment profitably employing the painting heating apparatus 4, a pattern 14 is baked on a surface of an article 8 such as pottery and glass containers, etc., as follows: First, a prescribed pattern 14 is adhered to the surface of the article 8 by drawing or painting paints of a metal oxide capable of developing prescribed colors with calcination and then the article 8 is housed in the housing part 9 of the heating apparatus 4 and sealed up with use of the cover 7. In succession, the heating apparatus 4 is placed in the cooking part of the electronic oven 5, and with the electronic oven 5 being switched on, microwaves for irradiation pass through the container 6 disposed on the outer wall of the heating apparatus 4 and the cover 7 and enters thereinto substantially without undergoing absorption loss and reach the heating medium 12 mainly composed as described before of the microwave absorption material 11 such as carbon and silicon carbide, etc., which heating medium 12 thereupon absorbs the irradiated microwaves effectively, reaches high temperature of about 900° C. in a short time, and becomes a hot-red state, due to radiation heat from which heating medium 12 the article 8 is indirectly heated whereby the pattern 14 is oxidized and baked on the base surface of the article 8.

Moreover, mixed the microwave absorption material 11 and the metal articles in a ratio of about 10:4, a result has been experimentally found that the final temperature and the speed of the temperature rise can be improved by about 50% likewise the second embodiment.

According to the fourth embodiment profitably employing the cooking heating apparatus 15, cooking is performed as follows: First, various kinds of articles 22 to be cooked are put in the heating apparatus 15, which apparatus 15 is then placed in the cooking part of the electronic oven. Then, the electronic oven is switched on in accordance with an ordinary method of cooking, microwaves irradiated in the electronic oven are effectively absorbed by the heating medium 19 of the heating apparatus 15, whereby the heating medium 19 is heated to high temperature in a short time. Due to radiation heat from the heating medium 19, the container 20 disposed in the oven is heated to cook the article 22 with the aid of heat transferred from the container 20 under the same heating conditions as those in heating cooking by an open fire.

Upon cooking with use of such an electronic oven, with the container 20 and the cover 21 comprising a material capable of reflecting microwaves such as stainless steel, etc., the article is heated only with radiation heat from the heating medium 19, while with the same comprising a material capable of absorbing microwaves such as pottery, etc., the microwaves are irradiated onto the article 22 disposed in the container 20 through the container 20 or the cover 21, and hence the article 22 is heated not only due to radiation heat from the heating medium 19 but also due to heat produced by permitting the article 22 to absorb the microwaves by itself. Accordingly, the heating by the radiation heat from the heating medium 19 is suitable for a case of needing heating powder equal to that by a strong open fire, while the heating by microwaves directly acting onto the article 22 is suitable for a case of rapidly heating the entire of the article 22 to a temperature at which water boils. Both are respectively optionally selected in accordance with how to cook the article in concern at that time.

In addition, with use of the cover 21 having a region capable of reflecting microwaves in part, the balance of the radiation heating from the heating medium 19 and the microwave heating directly acting on the article 22 can be adjusted as needed.

According to the fifth embodiment, after an article W to be heated is housed in the furnace interior space 24, microwaves from the microwave irradiation equipment 29 are irradiated on the heating wall material 26 opposing to the microwave irradiation apparatus 29 through the heat insulating material 27. The microwave absorption material included in the heating wall material 26 absorbs the microwaves so irradiated and produces heat together with heat production effected by the carbon fraction contained in the metal particles in the same manner, the carbon fraction furthermore reflecting properly the microwaves to enhance the absorption efficiency exhibited by the microwave absorption component. The heating wall material 26 constituting the heating medium 25 is thus allowed to absorb almost all the microwaves and is heated to high temperature in itself, whereby the article W disposed in the furnace interior space 24 is indirectly heated by the irradiation heat received from the heating medium 25 accompanied by heating of the heating wall material 26.

According to the sixth embodiment, an article W to be heated is placed on the conveyor device 33 and conveyed in succession from the inlet 35 to the outlet 36, while microwaves from the microwave irradiation equipment 44 are guided through the waveguide 45 and irradiated on the heating medium 43 disposed in the furnace 34, whereby the microwave absorption material constituting the heating medium 43 absorbs the irradiated microwaves and produces heat. Due to radiation heat from the heating medium 43 the article W conveyed by the conveyor device 33 is subjected to radiation heating in the course of passing through the furnace 34 in accordance with a prescribed temperature gradient set in the furnace 34.

Furthermore, the heating apparatus 32 according to the sixth embodiment can arbitrarily set the temperature gradient formed in the furnace 34 by adjusting the power of the microwaves radiated from the microwave irradiation apparatus 44 for drying or calcining pottery, foods, and other proper materials.

The microwave absorption material and/or the metal particles are mixed into the heating medium or allowed to adhere thereto, and microwaves are irradiated on such a heating medium. The microwave absorption material 3 and/or metal particles is mixed with or adhered to the heating medium 2 composed mainly of the pottery raw material and the microwave is radiated on the heating medium 2 so that the microwave is radiated on the heating medium 2 in the electronic oven. Hereby, the microwave absorption material 3 is adapted to absorb the microwaves, whereby the heating medium 2 can be heated in itself to high temperature equal to that of open fire. Thus, the article placed in the heating medium 2 can be cooked by the heat transfer action from the wall surface of the heating medium 2 which is producing heat naturally in the same manner as in an open fire. In addition, since the heating medium 2 itself produces heat, temperature of the article after cooked can be anticipated to be kept unchanged.

Moreover, since the microwave absorption material 3 and the metal particles are mixed into the heating medium or allowed to adhere thereto as described above, the available high temperature obtained by irradiation of microwaves and the speed of the temperature rise can greatly be improved.

In addition, the heating apparatus 4 to be housed in the domestic electronic oven 5 is formed by a heat insulating material, the interior of which heating apparatus 4 is employed as the container 6 for an article 8 such as pottery and glass containers, etc., to be painted. The heating medium 12 mainly composed of the microwave absorption material 11 and/or the metal particles is disposed on the inner peripheral wall part 10 of the container 6 in a confronting relation with the painting surface 13 of the article 8, which heating medium 12 is irradiated with microwaves. Accordingly, a simple kiln capable of raising temperature to about 1000° C. in a home with ease can be provided with use of the domestic electronic oven 5, whereby any pattern 14 can be baked in earnest on the surface of the article 8 such as pottery and glass containers in a home. Moreover, a non-flame heating action by microwaves in the electronic oven 5 is employed as a heat source without use of heat produced by burning of gas, etc., with a flame, and hence the operation of the heating apparatus is free from danger. Still more, also in industrial applications, the present apparatus can be effectively employed for china-painting of many kinds and a small quantity. Furthermore, the heating medium 12 can reach high temperature in a short time after irradiation of microwaves, while surfaces opposing to the heating medium 12 can be heated in part by radiation. In addition, rapid lowering of temperature can be assured by interrupting the irradiation of microwaves. Accordingly, although china-painting to, for example, a crystal product of a low softening point, particularly to a beaker having a thin elongated leg, was conventionally impossible, such a product can also be subjected with ease to china-painting without deforming a leg part thereof.

In addition, the heating medium is mainly composed of the microwave absorption material 11 and the metal particles, whereby the attainable heating temperature and the speed of the temperature rise by irradiation of microwaves can sharply be improved.

Moreover, the heating medium 19 mainly composed of the microwave absorption material 18 is arranged on the inner wall part 17 of the heat insulating outer casing 16, and the container 20 is mounted so as to be surrounded by the heating medium 19 while the container 20 is covered with the cover 21, the heating medium 19 being adapted to be irradiated with microwaves. Accordingly, by irradiating the heating apparatus 15 in the electronic oven with microwaves, the heating medium 19 surrounding the container 20 is adapted to absorb the microwaves and is thereby heated to high temperature. Thus, the article 22 can be cooked by radiation heat from the heating medium 19 through the container 20 under the same conditions of high temperature heating as those in an open fire by a flame. In addition, with the container 20 and the cover 21 being formed with a material capable of reflecting microwaves, the article 22 can be heated in the same manner as in heating by a strong open fire without being directly heated by microwaves, while with the container 20 and the cover 21 being formed with a material capable of absorbing microwaves, the article 22 is subjected not only to heating by radiation from the heating medium 19 but also to direct heating by microwaves. Therefore, effective heating obtained by the direct heating or the microwave heating can be assured, which can accordingly be applied to various cooking for rice, meat, and other foods. Moreover, the heating medium 19 produces heat in itself, while the heating apparatus 15 is adapted to have the heat insulating outer casing 16, whereby the heating apparatus can exhibit a heat insulation effect satisfactorily serving as a heat insulating container after cooking.

Furthermore, the heating wall material 26 is formed by a material mainly composed of the microwave absorption material and the metal particles via the heat resistant binder. A furnace wall is constructed with the healing wall material 26, while the heat insulating material 27 capable of transmitting microwaves is disposed on the outer peripheral part of the heating wall material 26 and furthermore the microwave irradiation apparatus 27 is arranged externally of the heat insulating material 27 in opposition to the heating wall material 26, the heating wall material 26 being irrradiated with microwaves from the microwave irradiation equipment 29. Accordingly, since the heating medium 25 is constructed with the heating wall material 26 by itself serving to effectively produce heat with irradiation of microwaves, the article W disposed in the furnace interior space 24 can effectively be heated by the radiation heat action of the whole of the heating medium 25, whereby even an article W having reduced absorptivity of microwaves can effectively be subjected to microwave heating corresponding to heat resistance of the heating wall material 26. In addition, the heat insulating material 27 capable of transmitting microwaves is disposed on the outer peripheral part of the heating wall material 26, and the microwave irradiation equipment 29 is arranged externally of the heat insulating material 27 in a confronting relation with the heating wall material 26. Therefore, incoming microwaves from the outside can be irradiated onto the heating wall material 26 without any attenuation thereof, while any heat can be prevented from diffusing outwardly of the heating wall material 26 for assuring effective heating. Furthermore, since the microwave absorption material is mixed into the heating wall material 26 together with the metal particles, the metal particles properly reflects microwaves being incident thereon for enhancing absorption efficiency by the microwave absorption component, and thereby heating efficiency of the heating wall material 26 can furthermore be improved. Moreover, also for the arrangement of the microwave heating apparatus 23, since the heating wall material 26 is employed in itself also as to heating medium 25, it can be simplified in its structure by the use of the heating wall material 26 and the heat insulating material 27, whereby it can widely be utilized as an inexpensive heating furnace for calcining and drying pottery and others.

Still more, the tunnel-shaped furnace 34 is arranged in the course of the conveyance path of the conveyor device 33. An article W to be heated is placed and conveyed on the conveyor device 33. On the furnace wall 42 inner surface, the heating medium 43 comprising a material mainly composed of the microwave absorption material is arranged. The microwave irradiation device 44 for radiating microwaves is arranged externally of the furnace 34 in a confronting relation with the heating medium 43, microwaves from which device 44 are irradiated on the heating medium 43. Accordingly, the article W conveyed on the conveyor device 33 can be heated in an arbitrary temperature gradient owing to radiation heat from the heating medium 43 effectively heated by the irradiation of the microwaves. In addition, since combustion gas is prevented from being produced unlike a combustion type furnace, adjustment of the atmosphere in the furnace such as pressure is facilitated, whereby the article W can be uniformly heated independently of a location of placing the article W. Moreover, since exhaustion of the combustion gas is made unnecessary, very excellent thermal efficiency can be assured without a fear of causing any environmental pollution. Furthermore, temperature in the furnace can be controlled with ease by electrically adjusting the microwave irradiation equipment 44, whereby practical effect can be greatly anticipated.

Although certain preferred embodiments have been shown and described, it should be understood that many changes and modifications may be made therein without departing from the scope of the appended claims.

What is claimed is:

1. A method of forming a painted object which comprises the steps of: placing in a microwave oven a closed container made of heat insulating material which is substantially transparent to microwave radiation, said container containing therein a glass or ceramic object having a surface decorated with a paint containing a metal oxide, the internal wall of said container being partially covered by a layer of microwave absorption material which is adhered to said internal wall and is disposed in directly confronting relationship only to the decorated surface of said object and is spaced therefrom, said microwave absorption material comprising a substance selected from the group consisting of powdered carbon and silicon carbide; and irradiating said container with microwaves whereby to heat said layer of microwave absorption material and thereby indirectly heat said object and oxidize and bake said paint on said decorated surface of said object without deforming said object.

2. A method as claimed in claim 1 in which said microwave absorption material includes at least one additional substance selected from the group consisting of brass powder and aluminum powder.

3. A method for cooking, comprising the steps of:

placing in a microwave oven a cup-shaped container having an open side, at least a part of which is made of heat insulating material which is substantially transparent to microwave radiation, said container having an internal cavity, all of the walls of which cavity are lined with and covered by a layer of microwave absorption material which is adhered to said walls, a cooking vessel having an open side and corresponding in shape to and snugly slidably received in said cavity and contacting the entirety of the inner surface of said layer of microwave aabsorption material, said cooking vessel containing a foodstuff therein, a cover closing the open side of said container and said vessel, said vessel and said cover being made of a material which can transmit or reflect microwaves; said microwave absorption material comprising a substance selected from the group consisting of powdered carbon and silicon carbide; and irradiating said container with microwaves to heat the contents of said vessel to a high temperature.

4. A method as claimed in claim 3 in which said microwave absorption material includes at least one additional substance selected from the group consisting of brass powder and aluminum powder.

* * * * *